US005727253A

United States Patent [19]

Wilkinson

[11] Patent Number: 5,727,253

[45] Date of Patent: Mar. 17, 1998

[54] PROCESS FOR DESIGNING CAMOUFLAGE CLOTHING

[75] Inventor: William Robert Wilkinson, Durango, Colo.

[73] Assignee: Bula, Inc., Durango, Colo.

[21] Appl. No.: 621,628

[22] Filed: Mar. 26, 1996

[51] Int. Cl.[6] ..... A41D 1/06

[52] U.S. Cl. ..... 2/69; 2/900; 428/919

[58] Field of Search ..... 2/69, 70, 227, 2/228, 108, 102, 94, 1, 900; 428/919; 430/9

[56] References Cited

U.S. PATENT DOCUMENTS

| | | |
|---|---|---|
| D. 265,774 | 8/1982 | Crumley . |
| D. 297,076 | 8/1988 | Kolpin et al. . |
| D. 299,793 | 2/1989 | Yacovella . |
| D. 326,363 | 5/1992 | Cooper . |
| 1,139,642 | 5/1915 | Cox . |
| 3,967,026 | 6/1976 | Dalbolm . |
| 4,576,904 | 3/1986 | Anitole . |
| 4,656,065 | 4/1987 | Yacovella . |
| 4,865,900 | 9/1989 | Shannon et al. . |
| 5,043,202 | 8/1991 | Knickerbocker . |
| 5,445,863 | 8/1995 | Slagle et al. . |

OTHER PUBLICATIONS

"Design to Ship: Done in a Day" by Monica Greco; Appeal Industry Magazine, Jun. 1995.

Cabela's 1994 Annual Fall Catalog p. 38, Brown Realtree Suit.

*Primary Examiner*—Gloria Hale

*Attorney, Agent, or Firm*—Knobbe, Martens, Olson & Bear LLP

[57] ABSTRACT

A realistic appearing camouflage system for personal wearing attire in which both the appearance and scale of a natural scene from an environment where the camouflage system is intended to be used is mimicked or enhanced. The camouflage system includes a first article of clothing imprinted with a portion of a photographic image of the natural scene in substantially the same scale as the natural scene. The camouflage system also includes a second article of clothing designed to be worn with the first article of clothing. The second article of clothing is imprinted with a second portion of the photographic image in substantially the same scale as the natural scene. The imprints of the first and second articles are located so that when the first and second articles are worn, the respective imprinted portions of the scene appear substantially continuous and the scene is reproduced both vertically and horizontally.

4 Claims, 6 Drawing Sheets

PROCESS FOR DESIGNING CAMOUFLAGE CLOTHING

BACKGROUND OF THE INVENTION

1. Field of the Invention

This invention relates to camouflage garments and a method for making such garments, and in particular to a camouflage system combining multiple products to cover the body so as to form a continuous, or correlated, camouflage from product-to-product, and to a method of transferring photographic images to fabric to create a realistic appearing camouflage.

2. Description of the Related Art

Traditionally, camouflage clothing patterns have taken the form of a repeated pattern of a particular hue or shade, in an attempt to simulate the natural environment. Thus, in forest areas, camouflage clothing appears as intermingled light and dark shades of green, with some brown mixed in. The patterns are typically abstract shapes, the intent being to break up the human outline against the particular background, and the design from the pants to the shirts is discontinuous. However, these prior art camouflage patterns have not adequately mimicked the intended environment due to the unrealistic nature of the patterns and the discontinuity in camouflage pattern from one item of clothing, such as pants, to another item of clothing, such as a shirt.

More recently, realistic artistic renditions of natural patterns, such as drawings of tree bark patterns, have been used on camouflage outfits in an attempt to overcome the limitations of traditional designs. However, the process of designing and rendering the patterns by hand is subjective, inaccurate, time consuming, and requires a designer with a high level of artistic skill as well as an understanding of the principles of camouflage design. Additionally, in designing a camouflage system incorporating several items of clothing, the quality and consistency of the rendition is subject to variations. Furthermore, no attempt has been made to design a camouflage system using renditions of natural patterns applied to multiple products, such as pants, shirt, and gloves, so that when worn together, the articles cover the body so as to form a continuous, or correlated, realistic camouflage pattern.

Still another technique used in an attempt to create more realistic camouflage patterns, and thus overcome the deficiencies of traditional camouflage patterns, involves taking a photograph of the environmental background where the camouflage pattern is intended to be used, and then processing the photograph to yield a somewhat random, high contrast pattern. The resulting pattern does not realistically resemble the object photographed, rather the resulting high contrast pattern lacks detail and resembles the abstract appearance of traditional camouflage patterns. In one implementation, the resulting pattern is copied by hand onto scale outline drawings of the object to be camouflaged. These drawings are then be used as masters from which artists hand copy the pattern onto the object to be camouflaged. Typically the pattern contains only two or three colors, such as black, light green and forest green. However this technique, which requires the camouflage pattern to be rendered by hand on each item to be camouflaged, is prohibitively expensive, and thus is not suitable for items of mass production, such as clothing. This technique is therefore relevant primarily to camouflage low quantity, high value items such as armored vehicles or buildings. Furthermore, this technique uses a very simple coloring scheme, and thus does not result in an accurate color replication of the photographed image used to create the pattern. Additionally, the pattern created by this technique appears somewhat random and abstract, and does not resemble the photographed object. Hence the resulting pattern is not a sufficiently realistic reproduction of the original object.

SUMMARY OF THE INVENTION

The present invention is a realistic appearing camouflage system and a method for making such a system. The camouflage system may be used for sporting purposes, such as hunting, or for military combat purposes, or for other applications where concealment is desirable. The realistic appearing camouflage system is for personal wearing attire in which both the appearance and scale of a natural scene, such as a tree, from an environment, such as a forest, where the camouflage system is intended to be used is advantageously mimicked or enhanced. The camouflage system includes a first article of clothing, such as a shirt, imprinted with a portion of a photographic image of the natural scene, such as an upper section of a tree trunk and associated branches, in substantially the same scale as the natural scene. The camouflage system also includes a second article of clothing, such as a pair of pants, designed to be worn with the first article of clothing. The second article of clothing is imprinted with a second portion of the photographic image, such as the lower portion of the same tree trunk printed on the shirt, in substantially the same scale as the natural scene. The imprints of the first and second articles are located so that when the first and second articles are worn, the respective imprinted portions of the scene appear substantially continuous and the scene is reproduced both vertically and horizontally. Thus, the camouflage system would resemble, by way of example, a tree trunk and associated branches.

In another aspect of the invention, the camouflage system includes a first article of clothing imprinted with a portion of a photographic image of the natural scene. The camouflage system also includes a second article of clothing designed to be worn with the first article of clothing. The second article of clothing is also imprinted with a second portion of the photographic image. The imprints of the first and second articles are located so that when the first and second articles are worn, the respective imprinted portions of the scene appear substantially continuous and the scene is reproduced both vertically and horizontally.

Another significant aspect of the invention is that the realistic appearing camouflage system is configured to mimic a natural scene, such as a tree. In the preferred embodiment of this invention, a first portion of a photographic image of the environment where the camouflage system is intended to be used is printed on a first clothing article, such as a shirt. The first portion of the photographic image might, by way of example, include an upper section of a tree trunk and branches with leaves. A second portion of the photographic image is printed on a second article of clothing, such as a pair of pants. The second portion of the photographic image might, by way of example, include a lower section of the tree trunk as well as grass. The second portion of the photographic image is correlated with the first portion of the photographic image so that when the shirt and pants are worn together, the first portion and the second portion of the image appear substantially continuous. Thus, the camouflage system would resemble, by way of example, a tree trunk, associated branches, and grass. Other examples of the first and second articles are articles of apparel selected from a group consisting of shirts, jackets, hats, masks, gloves, pants, shorts, jumpsuits, overalls, socks, shoes, capes, knapsacks and eyewear.

A significant feature of the preferred embodiment of this invention is that the first portion of the photographic image disposed on the first article is realistically colored, and the second portion of the image disposed on the second article is also realistically colored. The photographic image may also be a computer enhanced photographic image. In still another preferred embodiment, the first and second articles are articles of apparel selected from a group consisting of shirts, jackets, hats, masks, gloves, pants, shorts, jumpsuits, overalls, socks, shoes, capes, knapsacks and eyewear. The first and second articles of clothing may also be comprised of pattern pieces.

Another significant aspect of the invention is a new method of manufacturing a realistic appearing camouflage system. This method includes the step of, first taking a photograph of a scene from the natural environment where the camouflage system is intended to be used. A first area of the photograph is selected and a realistic image of the first area is printed on a first article of clothing. A second area of the photograph substantially continuous with the first area is also selected and a realistic image of the second area is printed on a second article of clothing so that when first article of clothing is worn with second article of clothing, the first realistic image is substantially continuous with the second realistic image.

A feature of the new method of this invention is that the step of taking the photograph of a scene from the natural environment advantageously includes photographing the selected scene so that the actual height of the scene photographed is substantially the height of the camouflage system. The realistic image of the first area and the realistic image of the second area are so printed that first realistic image and the second realistic image are substantially to original scale. In a particularly advantageous embodiment, the method includes printing the first realistic image and printing the second realistic image using a four color process.

In yet another aspect of the present invention, a selected area of a realistic color image of an environment where the camouflage system is intended to be used is disposed on a first article of clothing. A second selected area of the realistic color image is disposed on a second article of clothing. The second area of the realistic color image is aligned with the first area of the realistic color image so that when the first and the second articles of clothing are worn, the first area and the second area of the image appear substantially continuous.

DETAILED DESCRIPTION OF THE PREFERRED EMBODIMENT

Figure 4:
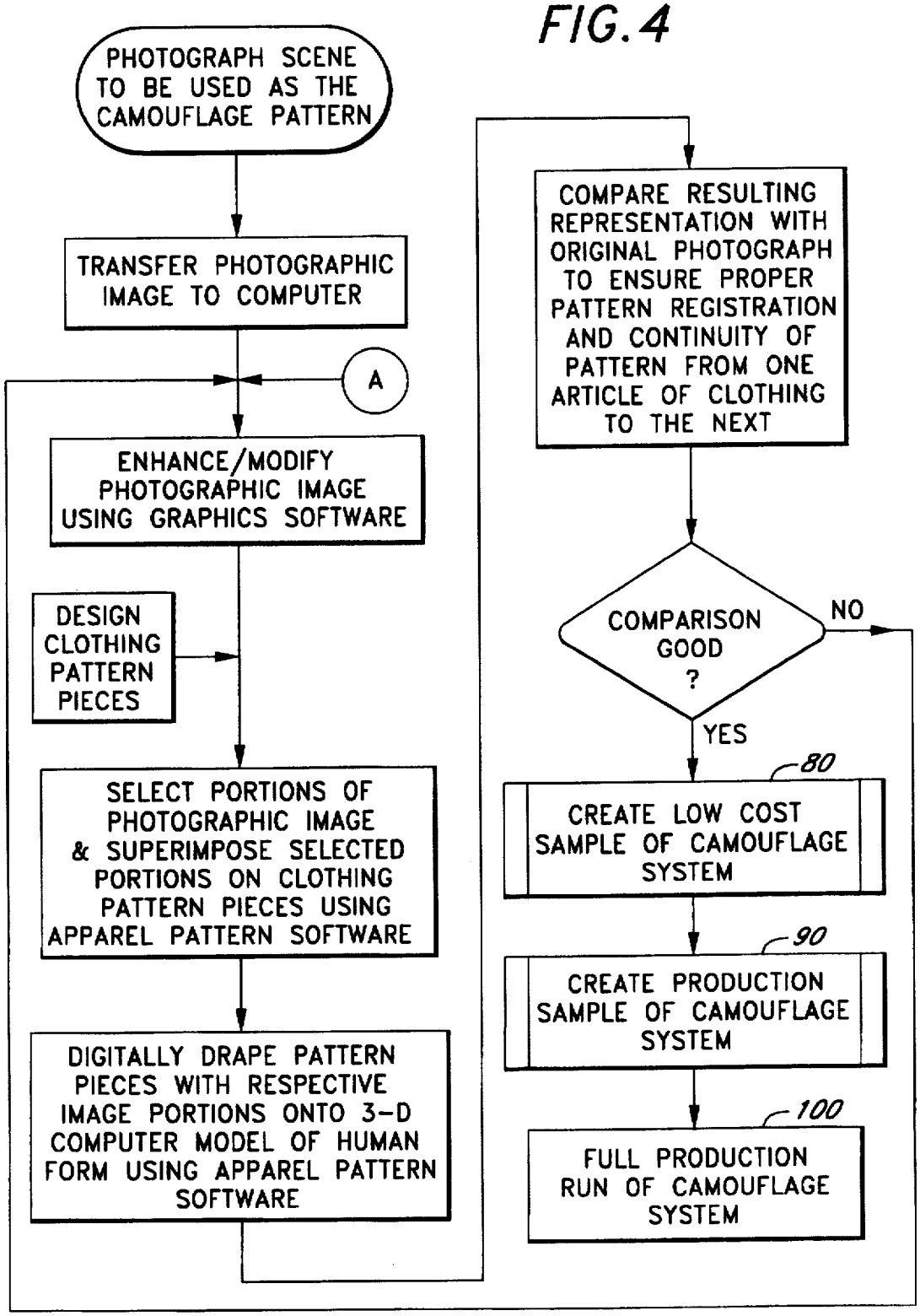
FIG. 4 is an overall flowchart of the method used in accordance with the present invention to design and create the camouflage system of FIG. 2.

FIG. 4 illustrates the overall method used to design and create a camouflage system in accordance with the present invention. The first phase of the technique is to take a color photograph of a scene which includes natural objects which are to be used in creating the camouflage pattern for the camouflage system. In the preferred embodiment, the photograph will be of a scene from the area where the camouflage system is to be used, such as, by way of example, a forest in Colorado. The camouflage system may include of a variety of clothing or other worn articles, including, but not limited to, shirts, jackets, hats, masks, gloves, pants, shorts, jumpsuits, overalls, socks, shoes, capes, knapsacks, backpacks or eyewear. It is understood that the term photograph used throughout this specification refers to both a photograph taken with a traditional film camera, and a photograph taken with a digital camera, as well as a photograph or visual recording taken by any other means.

Figure 1:
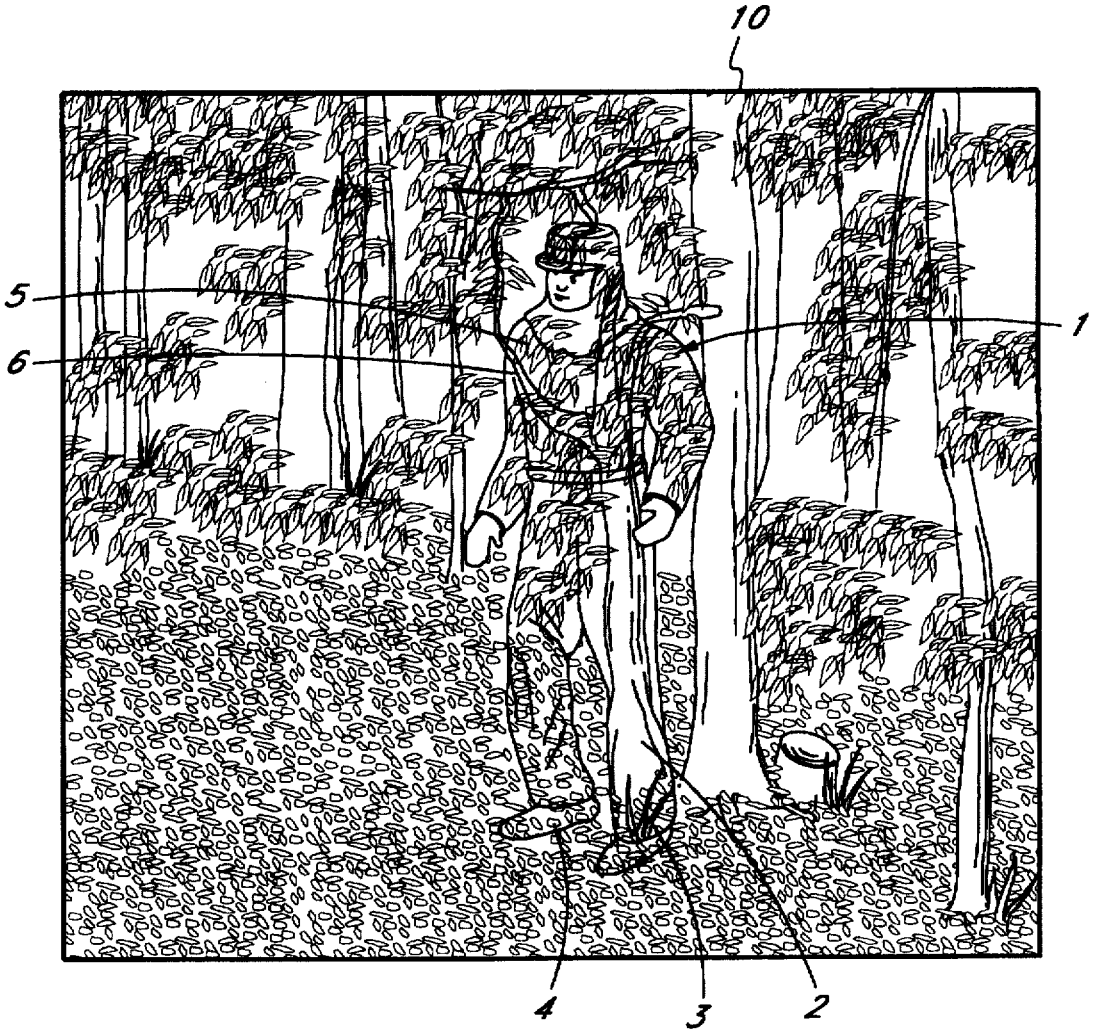
FIG. 1 is a drawing representative of a color photograph depicting a natural environment which can be used to create a natural, accurately colored, camouflage pattern.

FIG. 1 is a representative photograph 10 of a scene overlaid by the camouflage system 1. The photograph 10 includes a brownish tree trunk 2 in the center of the frame, green grass 3 and fallen red and brown leaves 4 at the lower portion of the frame, and brown and red leaves 5 attached to branches 6 at the upper portion of the frame. The photograph 10 is taken from such a distance so that the height of the scene within the frame is approximately 6 feet 4 inches. This permits an approximately 1—1 scale of the original scene to be applied as a camouflage pattern to the camouflage system 1 of clothing articles.

Next, the photograph 10 of the scene is transferred to a personal computer system (PC). The transfer may be achieved a number of known methods, such as by scanning the hardcopy photograph 10, thereby translating the photograph 10 into a realistic digital representation of the photograph 10 which can then be manipulated by the PC, or by directly transferring a digital photograph taken by a digital camera.

Figure 2:
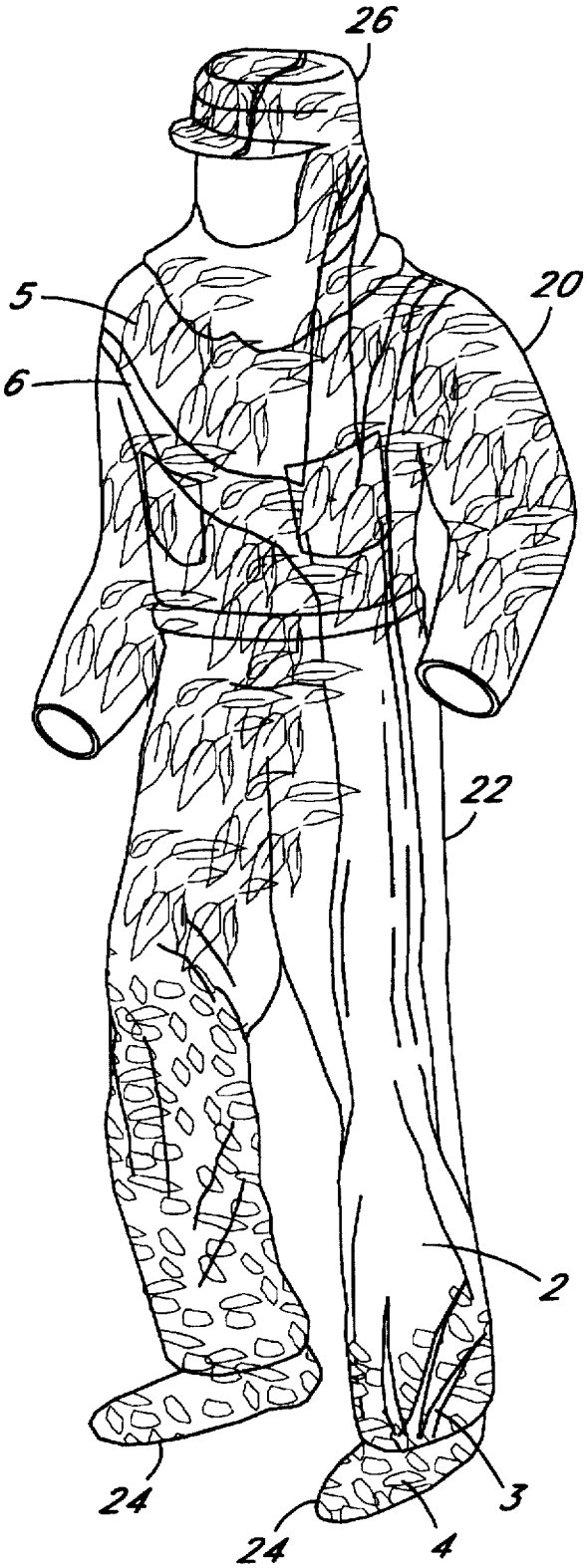
FIG. 2 is a drawing representative of a camouflage system.

Once the digital representation of the scene is resident on the PC the digital representation may be manipulated by a graphics software program, such as, by way of example, Crystal from Cactus Systems. The graphics program can be used by an operator to enhance the lighting of the scene. Lighting enhancements may take the form of removing inappropriate shadowing existing in the original photograph 10 or correcting for poor lighting conditions. The operator may, if necessary, also use the graphic program to manipulate elements within the digital representation. For example, once the photographed scene is applied to the articles of clothing, such as the jacket 20, pants 22, boots 24, and the hat 26, which comprise the camouflage system 1, as illustrated in FIG. 2, should a branch within the photograph totally cover the hat 26, thus rendering it all brown, it may be desirable to move the branch so it goes across the jacket 20. The graphics program may also be used to perform color enhancement and balancing of the photograph. Thus, if the photograph 10 of the scene was taken in the fall, with the result that the leaves 5 within the photograph 10 are brown or red, but the camouflage system 1 is intended to be used in the spring, the color of the leaves 5 may be changed to green so as to more closely resemble spring foliage.

Once the aforementioned manipulations have been completed, the resulting digital image of the actual scene may be operated on by any one of a number of digital apparel pattern software systems, such as, by way of example, Polynest from Polygon Software and Technology.

Figure 3B:
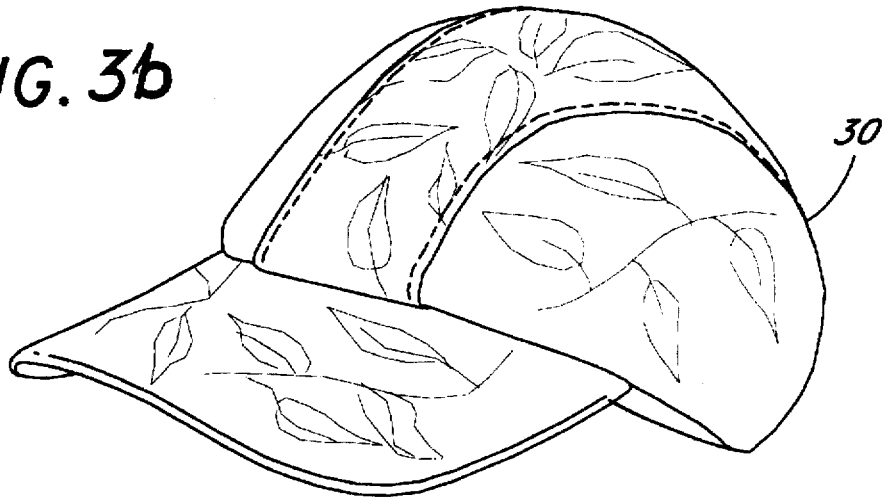
FIG. 3*b* is a drawing of the pattern pieces from FIG. 3*a* assembled into an article of clothing.
Figure 3A:
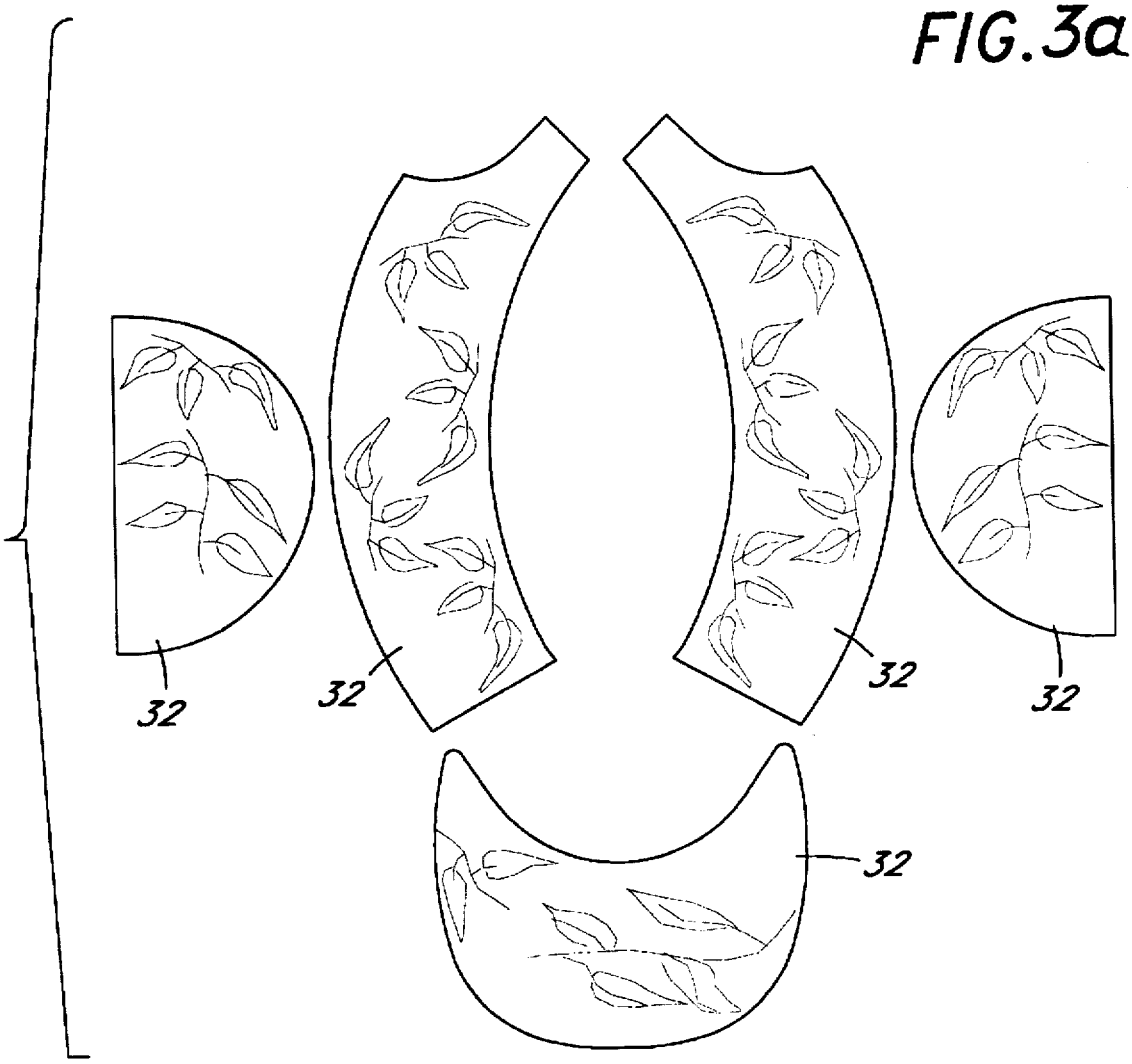
FIG. 3*a* is a drawing of the camouflage pattern of FIG. 2 as applied to pattern pieces of an article of clothing.

First, pattern pieces for the articles of clothing are designed using any one of a number of known methods. The operator uses the apparel pattern software to select portions of the resulting digital image and to superimpose those portions onto respective digital images of pattern pieces for the different articles of clothing comprising the camouflage system 1. Thus, by way of example, the top portions of the digital image of the actual scene containing leaves would be superimposed on pattern pieces 32 for a hat 30 as illustrated in FIGS. 3*a* and 3*b*, while the middle portion of the digital image of the actual scene containing the trunk of the tree 2 would be superimposed on the jacket 20. In one embodiment, the portion of the digital image superimposed on the back of the jacket 20 would be the mirror image of the pattern applied to the front of the jacket 20. The superimposed images act as the camouflage pattern for the respective pattern piece. The superposition of the resulting digital image onto the pattern pieces should be such that when the pattern pieces are assembled into the finished articles of clothing comprising the camouflage system 1, the camouflage system 1 mirrors the resulting digital image both vertically and horizontally. Thus, the camouflage pattern is properly registered so that it is continuous, or correlated, from one article of clothing to the next article of clothing as illustrated in FIG. 2.

Next, the operator uses the apparel pattern software to digitally drape the flat pattern pieces, with their superimposed digital images, onto a three dimensional computer models of the human form. The operator then compares the image of the draped pattern pieces with the original photograph to ensure that the camouflage pattern is properly registered and is continuous, or aligned, from one article of clothing to the next article of clothing.

Figure 5:
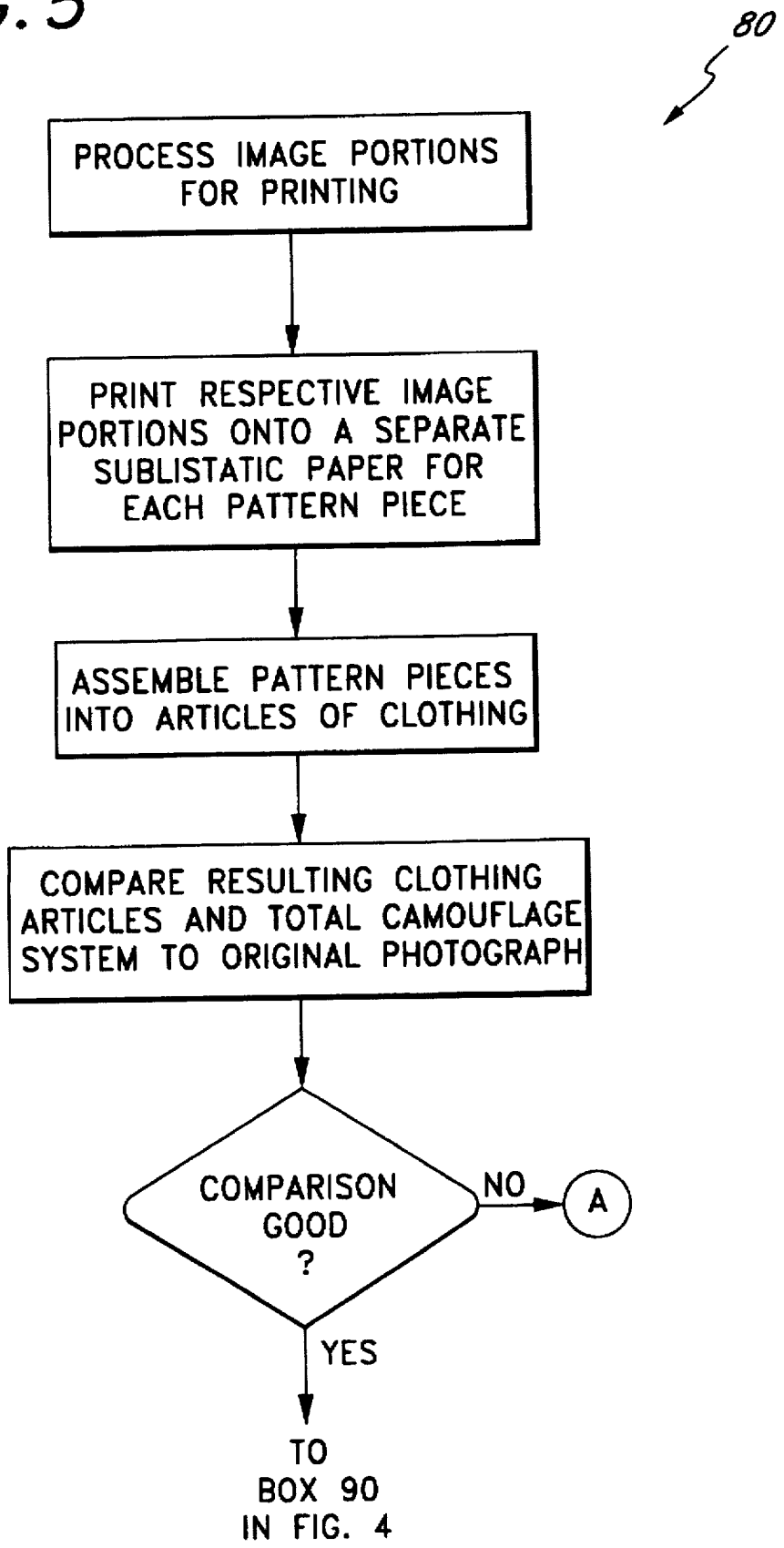
FIG. 5 is a flowchart of the submethod used to create a low cost sample of the camouflage system within the low cost sample subroutine block of FIG. 4.

Once the above steps are completed, a sample of the articles of clothing is created as a verification of the design of the camouflage system 1. A low cost process of creating the sample is used, as illustrated by the submethod 80 in FIG. 5, rather then the expensive four color separation process used in a production environment. First, portions of the digital image which are to be applied to physical pattern pieces are transferred to a Powermac or equivalent equipment. Next, the portions of the digital image are processed by the graphics software program for printing. The portions are then respectively printed onto a sublistatic paper for each pattern piece using an electrostatic printer capable of printing on fabric, such as, by way of example, a Cactus XES 8954-2T electrostatic printer using Cactus toner. Ink on the sublistatic paper is applied to cut white or other base fabric pattern pieces using a heat transfer unit, such as one manufactured by Astrotechnologies. The pattern pieces are then assembled into articles of clothing and compared to the original photograph. If the assembled clothing are not satisfactory, the images applied to the pattern pieces may be modified as necessary by the appropriate foregoing image enhancement or superpositioning steps and a new sample can be made.

Figure 6:
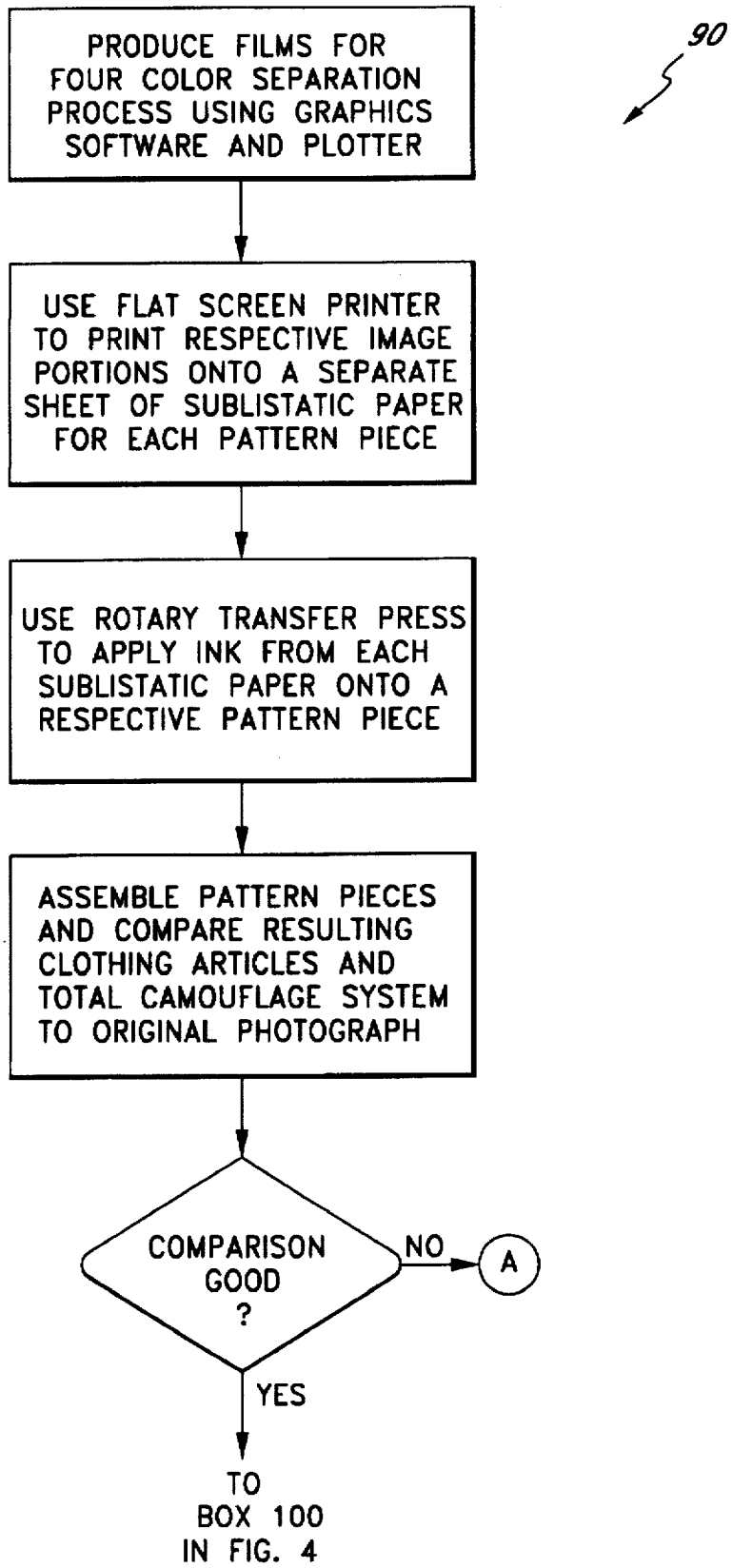
FIG. 6 is a flowchart of the submethod used to create a production sample of the camouflage system within the production sample subroutine block of FIG. 4.

After a satisfactory sample has been created the apparel production process may proceed, as illustrated by the submethod 90 in FIGS. 4, 6. A four color process is used to ensure that the camouflage system 1 is accurately and realistically colored. First, four color process separations are produced using the aforementioned graphics software. Each of the color separations are printed out onto a respective film, using a plotter, such as, by way of example, a Crystal plotter. The films are then rendered onto screens in the traditional manner. The screens are subsequently placed in a flat screen printer, such as one manufactured by Svecia. The flat screen printer is then used to print production runs of sublistatic paper, with a separate image for each pattern piece. Next a rotary transfer press, such as one from Astrotechnologies, is used to apply ink from each sublistatic paper to a respective cut white pattern piece. The cut pieces are then assembled and compared to the original photograph. If the results are satisfactory, a full production run can be made as illustrated in FIG. 4 by the submethod 100.

Although this invention is described in terms of specific embodiments, it is not limited thereto, as would be understood by those skilled in the art, numerous variations are possible within the scope of the invention, without departing from the scope and nature thereof.

What is claimed is:

1. A method of manufacturing a realistic appearing camouflage system, said method comprising the steps of:

(a) taking a photograph of a scene from the natural environment where the camouflage system is intended to be used;

(b) selecting a first area of said photograph and priming a first realistic image, created from said photograph, of said first area on a first article of clothing;

(c) selecting a second area of said photograph substantially continuous with said first area and printing a second realistic image, created from said photograph, of said second area on a second article of clothing so that when first article of clothing is worn with second article of clothing, said first realistic image is substantially continuous with said second realistic image.

2. The method of claim 1 wherein step (a) further includes photographing the selected scene so that the actual height of the scene photographed is substantially the height of the camouflage system.

3. The method of claim 1 wherein step (b) further includes printing said first realistic image of said first area so that the printed first realistic image is substantially to original scale.

4. The method of claim 1 wherein step (b) includes printing of said first realistic image using a four color process.

* * * * *

UNITED STATES PATENT AND TRADEMARK OFFICE

CERTIFICATE OF CORRECTION

PATENT NO. : 5,727,253

DATED : March 17, 1998

INVENTOR(S) : Wilkinson

It is certified that error appears in the above-identified patent and that said Letters Patent is hereby corrected as shown below:

In Column 6, Line 33, change "priming" to --printing--.

Signed and Sealed this

Twenty-second Day of June, 1999

*Attest:*

*Attesting Officer*

Q. TODD DICKINSON

*Acting Commissioner of Patents and Trademarks*